US009993739B2

(12) United States Patent
Weeks

(10) Patent No.: US 9,993,739 B2
(45) Date of Patent: Jun. 12, 2018

(54) TRANSFORMABLE TOY ROBOT

(75) Inventor: David Weeks, Brooklyn, NY (US)

(73) Assignee: David Weeks Studio LLC, Brooklyn, NY (US)

( * ) Notice: Subject to any disclaimer, the term of this patent is extended or adjusted under 35 U.S.C. 154(b) by 1241 days.

(21) Appl. No.: 13/305,185

(22) Filed: Nov. 28, 2011

(65) Prior Publication Data

US 2012/0156960 A1 Jun. 21, 2012

Related U.S. Application Data

(60) Provisional application No. 61/425,684, filed on Dec. 21, 2010.

(51) Int. Cl.

| | |
|---|---|
| ***A63H 13/00*** | (2006.01) |
| ***A63H 3/04*** | (2006.01) |
| ***A63H 3/46*** | (2006.01) |
| ***A63H 33/00*** | (2006.01) |

(52) U.S. Cl.

CPC ..... *A63H 3/04* (2013.01); *A63H 3/46* (2013.01); *A63H 33/003* (2013.01)

(58) Field of Classification Search

CPC ..... A63H 33/003; A63H 3/46; A63H 3/04
USPC ..... 446/354, 368, 376, 380
See application file for complete search history.

(56) References Cited

U.S. PATENT DOCUMENTS

| | | | | |
|---|---|---|---|---|
| 1,329,959 | A * | 2/1920 | Criest | 446/333 |
| 1,555,661 | A * | 9/1925 | Grove | 446/380 |
| 2,106,148 | A | 1/1938 | Kellner | |
| 2,825,178 | A * | 3/1958 | Hawkins | 446/119 |
| 3,222,072 | A * | 12/1965 | Dreyer | 273/157 R |
| 3,577,673 | A * | 5/1971 | Monestier | 446/490 |
| 4,699,602 | A * | 10/1987 | Giorgi | 446/124 |
| 4,790,714 | A | 12/1988 | Schnapp | |
| D306,621 | S | 3/1990 | Doi | |
| 4,997,375 | A * | 3/1991 | Heinz | 434/403 |
| 5,110,130 | A * | 5/1992 | Aulicino | 273/153 S |
| 5,310,378 | A | 5/1994 | Shannon | |
| 5,525,089 | A * | 6/1996 | Heinz | 446/119 |
| 5,628,667 | A * | 5/1997 | Levi | 446/278 |
| 6,086,446 | A | 7/2000 | Arriola | |

(Continued)

FOREIGN PATENT DOCUMENTS

GB 2298586 A * 9/1996

*Primary Examiner* — Vishu Mendiratta
(74) *Attorney, Agent, or Firm* — Sheppard, Mullin, Richter and Hampton, LLP; Jesse Salen

(57) ABSTRACT

A system for interconnecting discrete rigid member mating components creates different stable, freestanding three-dimensional figures such as robots. The mating components are positioned in tandem employ an elastic element through bores and each mating component has at least one slot that is aligned with a corresponding slot formed on adjacent mating component or body. The arrangement of the slots and elastic element permits each mating components to be maneuvered onto an adjacent mating component and retains its position without the use of hinges or other securing devices. A reconfigurable toy is constructed by interconnecting a plurality of different sized mating components. The mating components can thus be rearranged to form different-shaped figures including a robot that is reversibly transformable between a first configuration, which can comprise a myriad of forms, and a second configuration that is a cube.

6 Claims, 8 Drawing Sheets

(56) References Cited

U.S. PATENT DOCUMENTS

| | | | | |
|---|---|---|---|---|
| 6,264,199 | B1 | 7/2001 | Schaedel | |
| 6,482,063 | B1 * | 11/2002 | Frigard | 446/119 |
| D474,514 | S | 5/2003 | Price | |
| D475,094 | S * | 5/2003 | Ko | D21/478 |
| 7,086,923 | B2 | 8/2006 | Karabees | |
| 7,651,398 | B2 | 1/2010 | Ostendorff | |
| 7,722,429 | B2 | 5/2010 | Campbell | |
| 7,731,563 | B2 | 6/2010 | Saucier | |
| 7,785,168 | B2 | 8/2010 | Yamada | |
| 8,393,623 | B2 * | 3/2013 | Storer | 273/156 |
| 2003/0172205 | A1 * | 9/2003 | Bastian | 710/45 |

* cited by examiner

TRANSFORMABLE TOY ROBOT

REFERENCE TO RELATED APPLICATIONS

The present application claims priority to U.S. Provisional application No. 61/425,684 filed on Dec. 21, 2010.

FIELD OF THE INVENTION

The present invention generally relates to a foldable toy robot that is transformable between alternative configurations and particularly to those that can be folded into a closed configuration having the shape of a cube.

BACKGROUND OF THE INVENTION

Transformable toys typically comprise figures equipped with hinges that enable the elements of the figures to be maneuvered so as to form different shapes. However, the presence of hinges or similar devices constrains the movement of the elements and limits the number of configurations to which the elements can be manipulated to form. In essence the designer of the toy fixes the potential forms that the toys can take. It is desirable to have a foldable toy in which the component parts are not attached to each other so that the parts can be arranged in a variety of poses limited only by a child's imagination.

SUMMARY OF THE INVENTION

The present invention is based in part on the development of a system for interconnecting discrete rigid member mating components such that the rigid members can be folded and positioned relative to each other to create different stable, free standing three dimensional figures. The mating components, which are positioned in tandem to form appendages, employ an elastic element that is positioned through bores within the mating components. No hinges, magnets, locking or latching devices are required. Each mating component has at least one slot that is aligned with a corresponding slot formed on an adjacent mating component or body.

In one aspect, the invention is directed to a three dimensional transformable toy that includes:

- a first outer mating component to which the first end of an elongated elastic element is secured;
- a second outer mating component to which the second end of the elongated elastic element is secured; and
- at least one inner mating component each defining a bore, wherein each inner mating component has a distal slot and a proximal slot, wherein the first, second and at least one inner mating components are aligned such that the elastic element extends linearly from the first outer mating component, through each bore of the at least one inner mating components, and to the second outer mating component, and wherein adjacent slots are linearly aligned such that each mating component can be maneuvered onto an adjacent mating component.

With the present invention, a reconfigurable toy can be constructed by interconnecting a plurality of mating components, which can be of different sizes and configurations. The mating components can be rearranged to form different-shaped figures. A preferred toy is a robot that is reversibly transformable between a first configuration, that can comprises a myriad of forms, and a second configuration that is in of a cube. Each toy can comprises 3 to 20 or more individual mating components that are all interconnected by one or more the elastic elements.

DESCRIPTION OF PREFERRED EMBODIMENTS

The present invention is directed to a foldable toy robot that is constructed from a plurality of blocks made of wood, plastic or other rigid material. One feature of the invention is that the toy robot can be folded into a hexahedron especially a regular hexahedron or cube. While the invention will be described in constructing a robot, it is understood that the three dimensional transformable toy can take the form of other animate objects.

Figure 1:
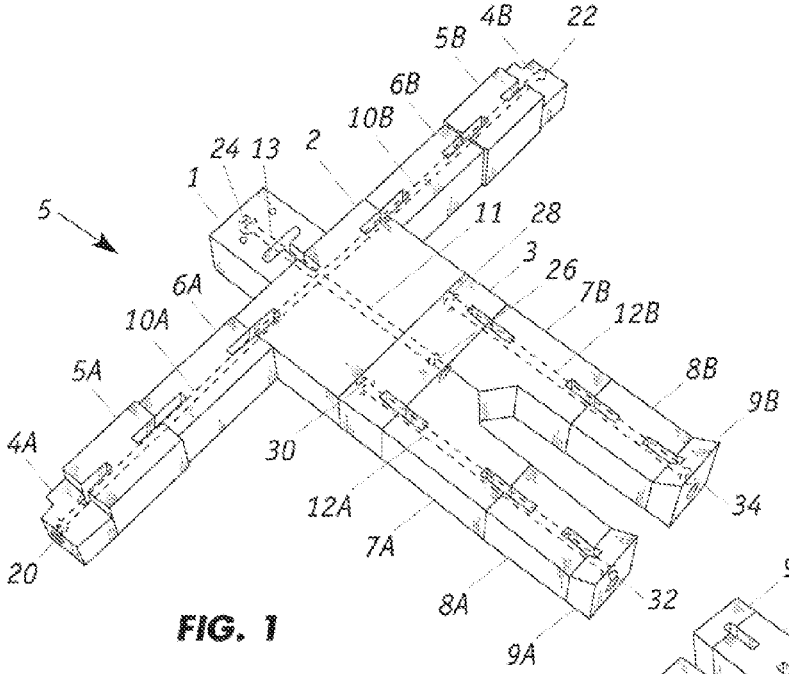
FIGS. 1 to 15 are perspective views depicting the sequence of folding the toy robot.

FIG. 1 depicts an embodiment of the puzzle 5 that has 15 individual blocks (or mating components) configured as selected anatomical parts, namely: head 1; upper torso 2; pelvis 3; right and left legs 7A, 7B above the knee; right and left legs 8A, 8B below knee; right and left feet 9A, 9B; right and left anus 6A, 6B above elbow; right and left arms 5A, 5B below elbow; and right and left hands 4A, 4B. The upper torso 2 and pelvis 3 comprise a body from which the two pairs of appendages are secured. In particular, the right arm includes upper arm 6A, lower arm 5A and right hand 4A while the left arm includes upper arm 6B, lower arm 5B and left hand 4B. Similarly, the right leg includes upper leg 7A, lower leg 8A, and right foot 9A while the left leg includes upper leg 7B, lower leg 8B, and left foot 9B. In a preferred embodiment as depicted in planar configuration shown in FIG. 1, the height of each block is the same except for hands 4A and 4B, which are shorter, and feet 9A and 9B, which are longer. Each block preferably has a flat surface that abuts or mates with the flat surface of an adjacent block. In constructing appendages, preferably three or more rigid block members are used with the inner mating component having two slots. For example, lower right arm 5A proximal and distal slots are further described herein.

Each block is secured to an adjacent block by one or more internal elastic elements such as elastic cords that allow each block to move independently including rotation about the axis defined by the elastic cord. Each block has one or more through holes or bores into which the elastic cords are inserted and one or two cut slots that allows the blocks to fold in different ways in conjunction to their adjoining piece. Each elastic cord preferably has a large knot, which is larger than the dimension of the through hole, at the two ends so that the elastic cord remains secured at the ends of the through holes. (Alternatively, each end of the elastic cord can be secured with a staple or other device.) In particular, knots 20 and 22 formed at the ends of elastic cord 10A, 10B are located in the right and left hands 4A and 4B, respectively. Knots 24 and 26 formed at the ends of elastic cord 11, 13 are located in head 1 and pelvis 3, respectively. Knots 30 and 32 formed at the ends of elastic cord 12A are located in pelvis 3 and right foot 9A, respectively, and knots 28 and 34 formed at the ends of elastic cord 12B are located in pelvis 3 and left foot 9B, respectively. As is apparently, instead of using a single elastic cord 11,13, multiple shorter elastic cords, each with a knot at the ends, can be employed.

As further shown in FIG. 1, head 1 is attached to the upper part of torso 2 by one end of elastic cord 11,13 while the lower part of torso 2 is connected to the upper part of pelvis 3 by the opposite end of elastic cord 11,13.

As described further herein, preferably, the slot(s) on each block are aligned with the slot(s) on the adjacent blocks and each slot defines a narrow groove with an open channel from one side of the block to the opposite side. The elastic cord in each block passes through the slot therein and, in this fashion, a block can be manipulated to move around and rest on different sides of an adjacent block.

Figure 2:
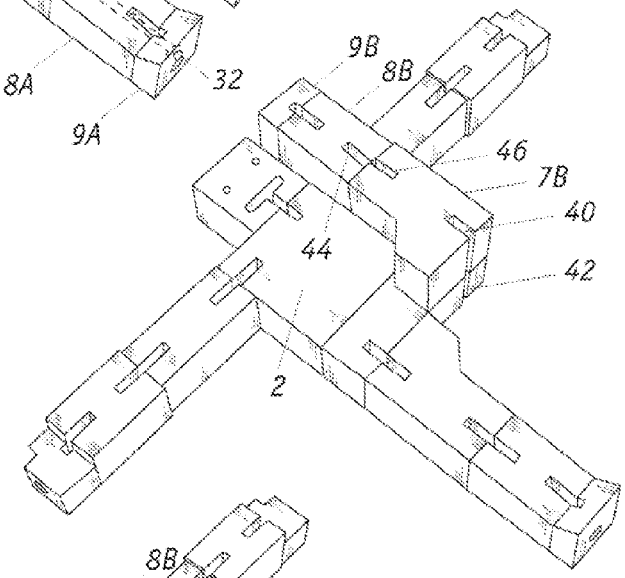
Figure 3:
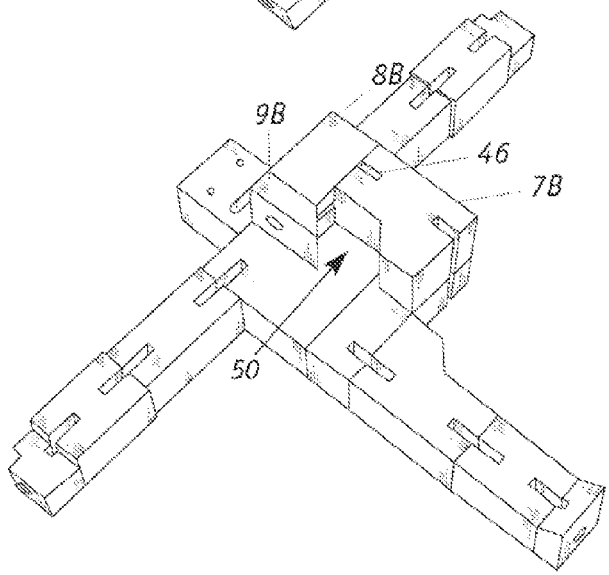
Figure 4:
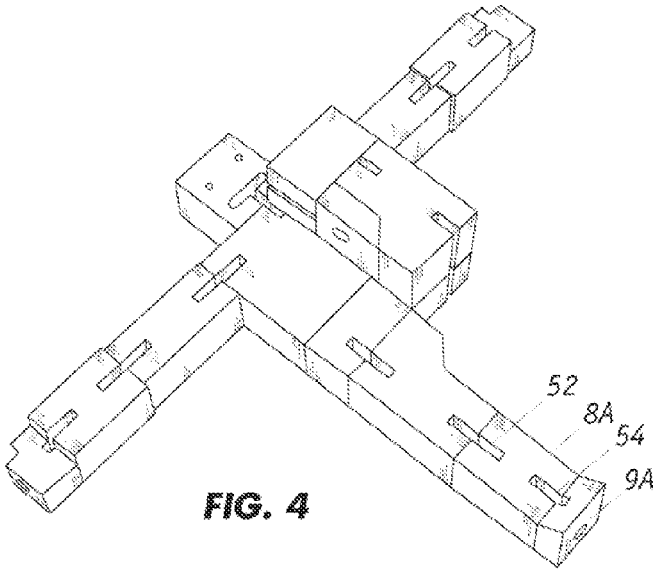

FIGS. 2 to 14 illustrate a sequence in which the robot-shaped puzzle is folded into a closed configuration in the shape of a cube. FIGS. 2 to 4 illustrate the positioning of the left leg onto upper torso 2 and pelvis 3. This is facilitated by the alignment of slot 40 in upper left leg 7B with slot 42 in pelvis 3 so that the elastic cord therein (not shown) wound around the groove defined by the groove in the slot. As further shown in FIG. 2, slot 44 of lower left leg 8B is aligned with adjacent slot 46 of upper left leg 7B, this in turn enables lower left leg 8B to be twisted and folded onto the front sides of pelvis 3 and upper torso 2 as shown in FIG. 3. Finally, left foot 9B is shifted and positioned into inner gap area 50. As shown in FIG. 4, the left leg is transformed into a fitted rectangular-shaped block placed over the torso and pelvis.

Figure 5:
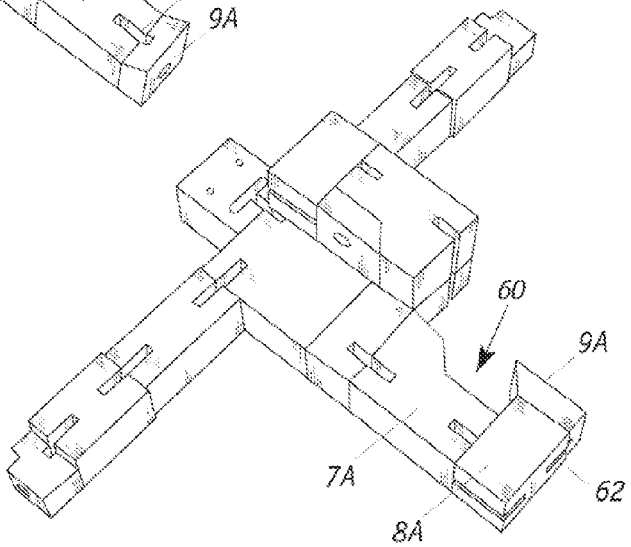
Figure 6:
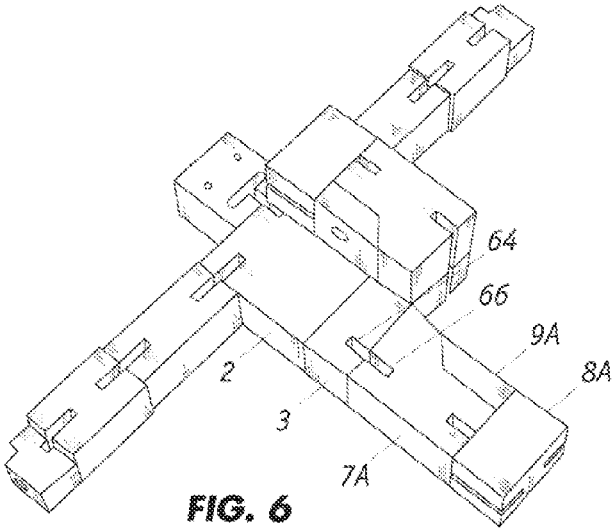
Figure 7:
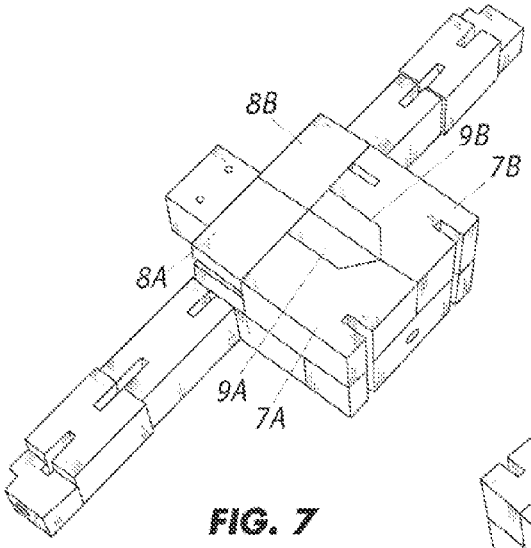
Figure 8:
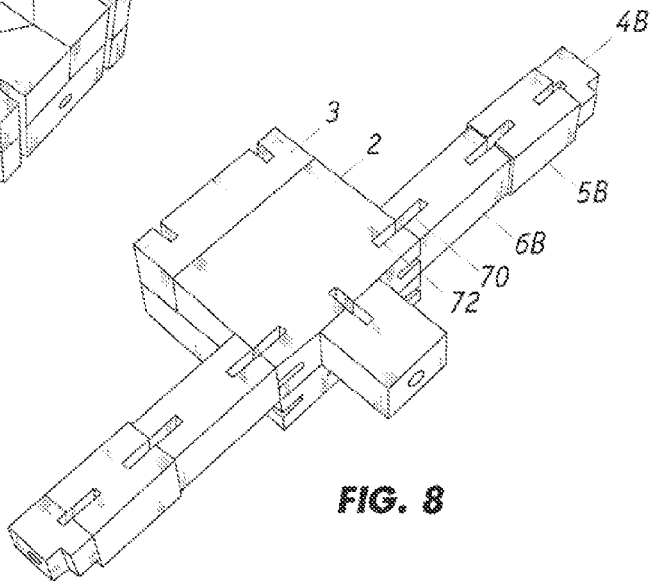
Figure 9:
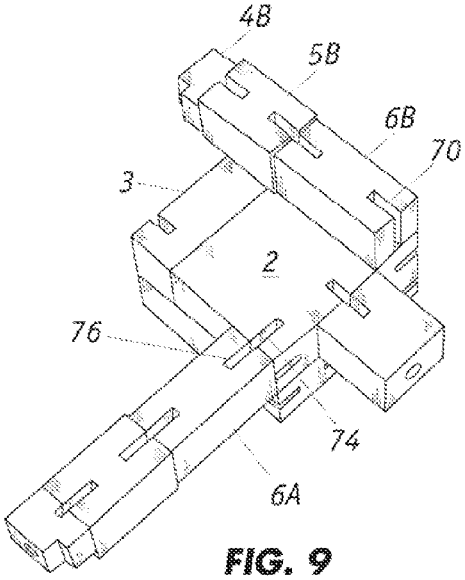
Figure 10:
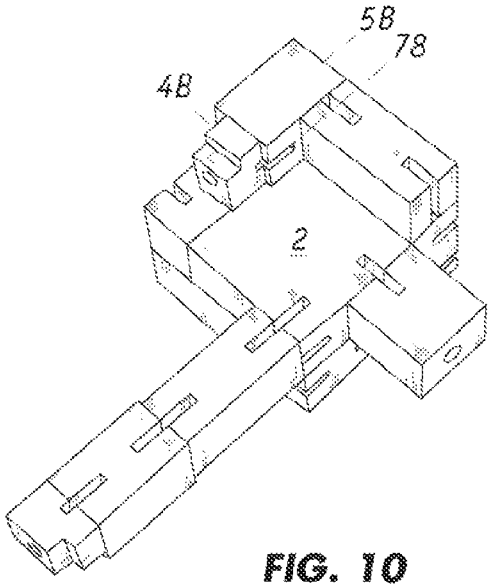
Figure 11:
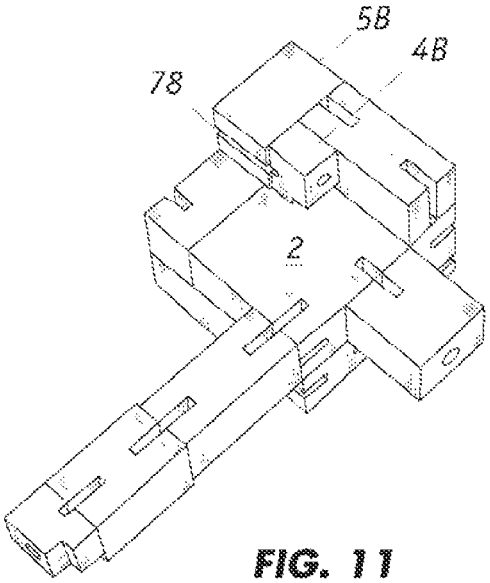

In a similar fashion as illustrated in FIGS. 5 and 7, with the aid of slots 52 and 54 in lower right leg 8A (FIG. 4) and coordination of aligned slot 64 and 66 (FIG. 6), the right leg is first twisted and then right foot 8A is shifted into gap area 60 to create a fitted rectangular-shaped block over upper torso 2 and pelvis 3. As shown in FIG. 7, the outer dimensions of the upper and lower fitted configurations consisting of the two blocks formed by the folding of the right and left legs, are preferably the same as that of the combined parts of the torso and pelvis.

Figure 12:
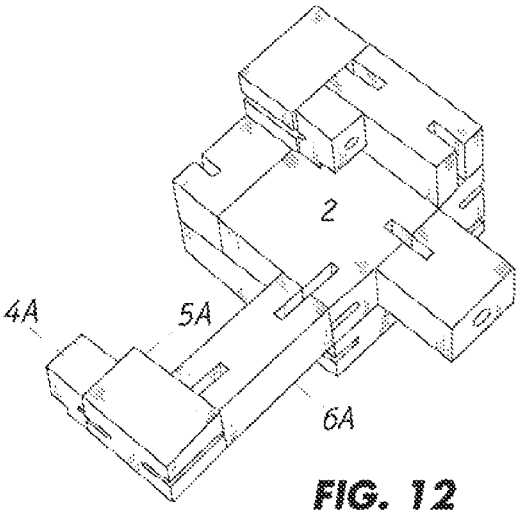
Figure 13:
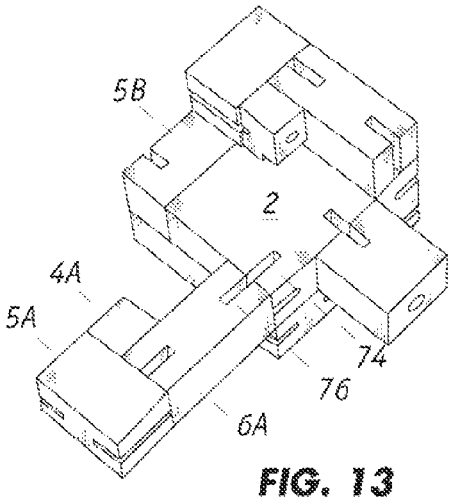
Figure 14:
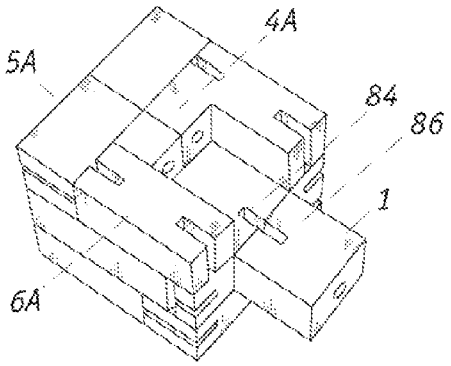
Figure 15:
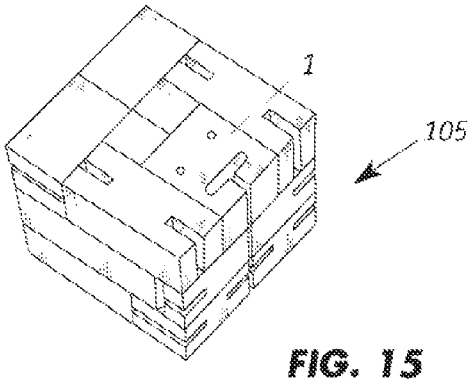
Figure 16:
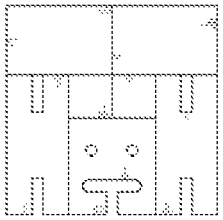
FIG. 16 is a front elevational view of a foldable toy robot.
Figure 17:
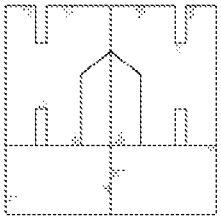
FIG. 17 is a rear elevational view thereof.
Figure 18:
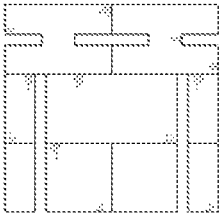
FIG. 18 is a top plan view thereof.
Figure 19:
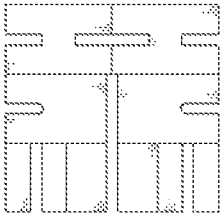
FIG. 19 is a bottom plan view thereof.
Figure 20:
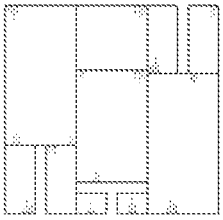
FIG. 20 is a left side elevational view thereof.
Figure 21:
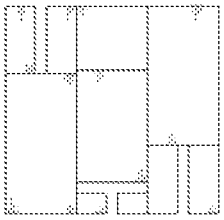
FIG. 21 is a right side elevational view thereof.

Next as depicted in FIGS. 8 to 13, the left and right arms are folded over the backside on upper torso 2 and pelvis 3. In particular, as shown in FIGS. 8 to 11, with the aid of slot 72 in pelvis 3 which is aligned with corresponding slot 70 in the upper left arm 6B, the left arm is folded onto the back of torso 2 and pelvis 3 and then left hand 4B is shifted along slot 78 and onto the inner part of lower left arm 5B. Similarly, as shown in FIGS. 12 and 13, with the aid of slot 74 in pelvis 3 which is aligned with corresponding slot 76 in the upper right arm 6A, the right arm is folded onto the back of torso 2 and pelvis 3 and then right hand 4A is shifted over lower right arm 5A. Finally, with the coordination of slot 84 on upper torso 2 and corresponding slot 86 on head 1, the head is folded into the space created by the folded arms to form cube 105 as shown in FIG. 15. The outer dimensions of the blocks formed by the folding of the right and left arms and the head, are preferably the same as that of the combined parts of the torso and pelvis. In this fashion, the reversibly transformable toy in this second configuration 105 has an outer contour that is that of a closed cube puzzle structure.

FIGS. 16 through 21 show the six sides of the toy robot in the folded cube-shaped configuration. As is apparent, in this geometric solid embodiment, the cube has three layers of assembled mating components that are arranged in a stack, namely, (1) the fitted configuration consisting of the torso and pelvis in the middle, (2) the fitted configuration consisting of the folded legs, and (3) the fitted configuration consisting of the folded arms and head.

Figure 22:
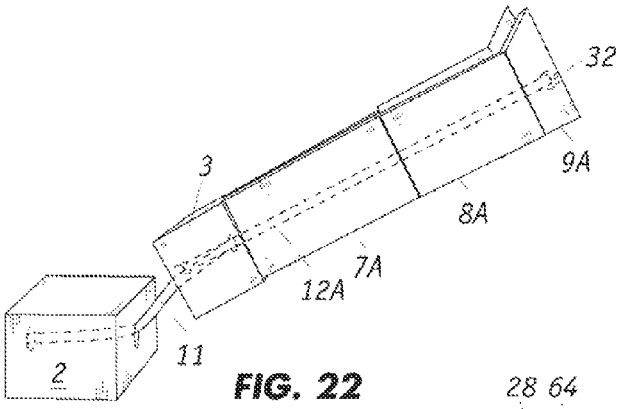
FIGS. 22 to 25 illustrative representative movements of adjacent members of the toy robot.
Figure 23:
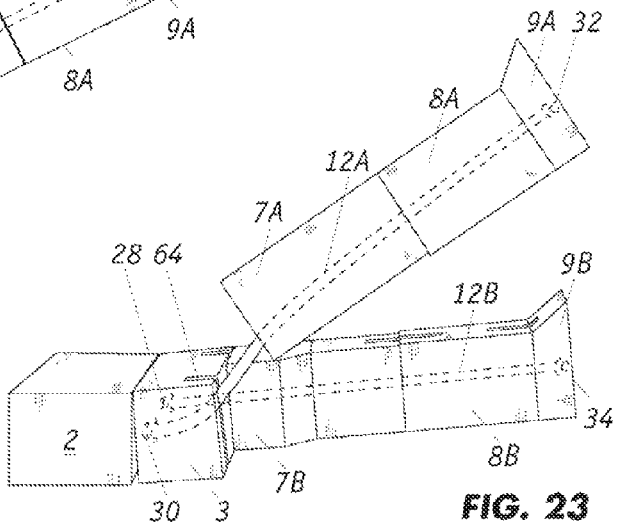
Figure 24:
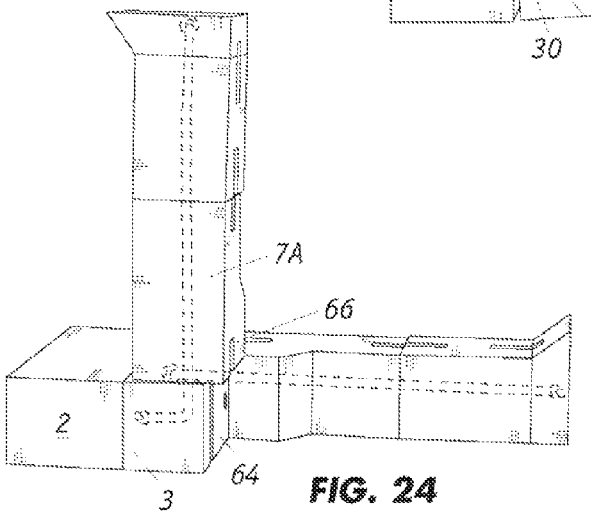

A feature of the invention is the ability of the rigid block members to be maneuvered and positioned relative to each other. This facility is attributable, in part, to the slot structures formed in the members and the associated elastic elements. FIGS. 22, 23 and 24, illustrates the manipulation of the legs relative to the body that consists of upper torso 2 and pelvis 3, which are movably attached by elastic cord 11. The right leg, which includes upper and lower right legs 7A, 8A and foot 9A, has an elastic cord 12A anchored by knots 30 and 32. The left leg, which includes upper and lower left legs 7B, 8B and foot 9B, has an elastic cord 12B anchored by knots 28 and 34. FIG. 22 shows that pelvis 3 can be pulled away from the adjacent upper torso 2 but because of the absence of corresponding slots, the pelvis cannot be folded over and onto the torso. Indeed, if pelvis 3 were folded onto the front side of upper torso 2, the biasing force exerted by the elongated elastic element 11 would pull the pelvis off.

Figure 25:
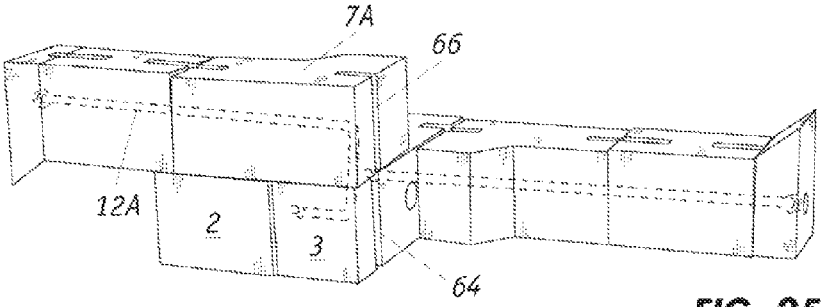

In contrast, as shown in FIGS. 23 to 25, both legs can be readily positioned onto the front surface of pelvis 3 that is configured with slots. For example, the alignment of slot 64 in pelvis 3 and corresponding slot 66 on upper right leg 7A permits the right leg to be folded and stably positioned on pelvis 3 as shown in FIG. 24. The depth of slots 64, 66 allows elastic element to fit into the grooves in slots 64 and 66 as shown in FIG. 24 minimizes the destabilizing forces that might otherwise pull the leg off pelvis 3. Another factor is with the slots, the elastic element is not stretched as much when the leg is in the folded position. As a result there is less force being exerted. Thus, even in the position shown in FIG. 25, the right leg remains in a stable position and would not cause the leg to "spring back."

Figure 26:
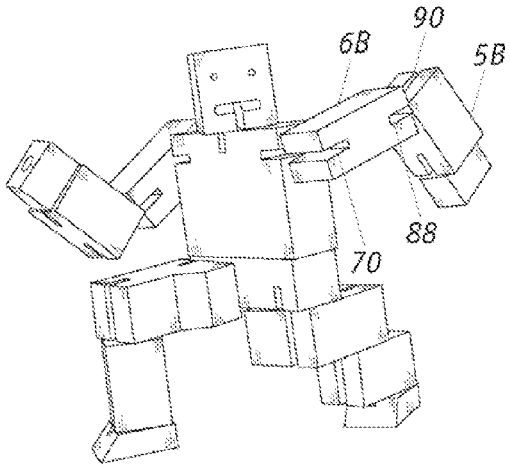
FIGS. 26 to 28 illustrate perspective views of the foldable toy robot with different positions and with parts thereof in alternative positions.
Figure 27:
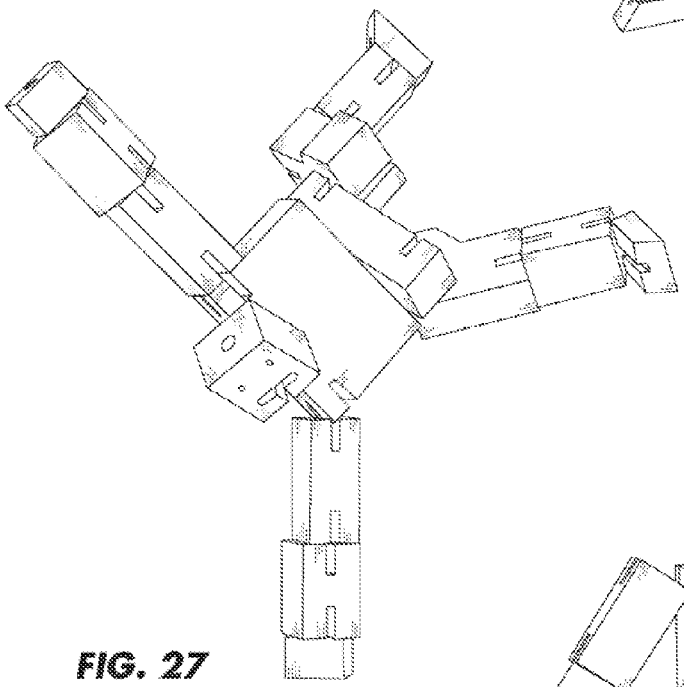
Figure 28:
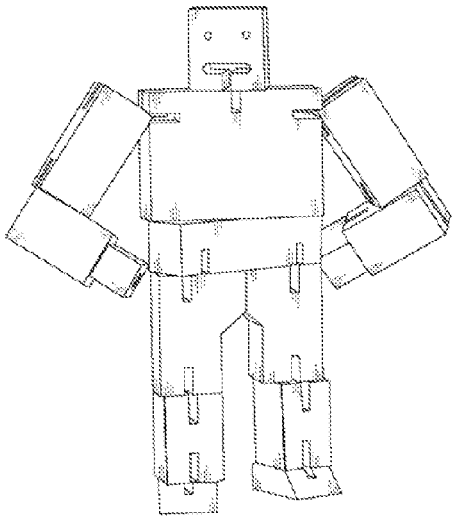

With the present invention, by modifying the positions of the rigid block members, different freestanding configurations of the character can be created. Each transformed robot configuration remains stable as shown in FIGS. 26 to 28, with no additional fixture or support needed to maintain the robot in the various positions. As shown in FIG. 26, the slots are dimensioned so that the edge of an adjacent rigid block can be stably positioned therein. Upper left arm 6B, which has slots 70, 88, is twisted and an edge lower left arm 5B with slot 90 fits into slot 88.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A toy reversibly transformable between a first configuration and a second configuration comprising:

a first component assembly including a plurality of mating components, said first component assembly including a first face having a perimeter, a second face having a perimeter and an edge extending between said perimeter of each of said first face and said second face;

a second component assembly including a plurality of mating components, said second component assembly including a first face having a perimeter, a second face having a perimeter and an edge extending between said perimeter of each of said first face of said second component assembly and said second face of said second component assembly; and a third component assembly including a plurality of mating components, said third component assembly including a first face, a second face and an edge extending between said first face of said third component assembly and said second face of said third component assembly;

wherein said third component assembly rotatably, foldably, and slideably couples to said first component assembly and said second component assembly, enabling the component assemblies to geometrically transition between a fitted configuration and an expanded configuration;

such that the component assemblies are can be configured in said fitted configuration such that:

said third component assembly is intimately interposed between said first component assembly and said second component assembly with;

said first face of said third component assembly directly opposing said second face of said first component assembly;

and said second face of said third component assembly directly opposing said first face of said second component assembly, such that said first component assembly, said second component assembly and said third component assembly together define a geometric solid; and the component assemblies can be configured in an expanded configuration such that:

at least one of said mating components in each of said first component assembly and said second component assembly abuts at least one further one of said mating components of a same one of said first component assembly and said second component assembly;

a portion of said edge of said first component assembly formed by at least one of said mating components of said first component assembly abuts one portion of said edge of said third component assembly; and a portion of said edge of said second component assembly formed by at least one of said mating components of said second component assembly abuts one further portion of said edge of said third component assembly, such that said first component assembly, said second component assembly and said third component assembly together define a humanoid figure.

2. The toy of claim 1 wherein each of said first component assembly, said second component assembly and said third component assembly, when said mating components respectively thereof are in the fitted configuration, is a parallelepiped such that when said third component assembly is interposed said first component assembly and said second component assembly such that said first configuration of said toy is a hexahedron.

3. The toy of claim 2 wherein each of said first component assembly, said second component assembly and said third component assembly have a substantially identical height to each other, further wherein each of said first component assembly, said second component assembly and said third component assembly have a substantially identical width to, each other and further wherein said edge of each of said first component assembly, said second component assembly and said third component assembly is of uniform depth, such that said hexahedron is a cuboid.

4. The toy of claim 3 wherein said height and said width are equal to each other and said depth is one third thereof such that said hexahedron is a cube.

5. The toy of claim 1 wherein, when said mating components in each respective one of said first component assembly, said second component assembly and said third component assembly are disposed in said fitted configuration, said edge of each of said first component assembly, said second component assembly and said third component assembly comprises a plurality of edge portions wherein each one of said edge portions of said edge of each of said first component assembly, said second component assembly and said third component assembly is contiguous with a corresponding one of said edge portions of said edge of an adjacent one said first component assembly, said second component assembly and said third component assembly such that contiguous ones of said edge portions define facets of said geometric solid.

6. The toy of claim 5 wherein said edge portions of said edge of each of said first component assembly, said second component assembly and said third component assembly include a first edge portion, a second edge portion, a third edge portion and a fourth edge portion, further wherein said first edge portion of said edge of each of said first component assembly, said second component assembly and said third component assembly being a first one of said facets, said second edge portion of said edge of each of said first component, assembly, said second component assembly and said third component assembly being a second one of said facets, said third edge portion of said edge of each of said first component assembly, said second component assembly and said third component assembly being a third one of said facets and said fourth edge portion of said edge of each of said first component assembly, said second component assembly and said third component assembly being a fourth one of said facets, and further wherein said first face of said first component assembly and said second face of said second component assembly respectively define fifth and sixth facets of said geometric solid.

* * * * *